US007042429B2

(12) United States Patent
Miyazawa et al.

(10) Patent No.: US 7,042,429 B2
(45) Date of Patent: May 9, 2006

(54) DISPLAY DEVICE AND METHOD OF DRIVING SAME

(75) Inventors: Toshio Miyazawa, Chiba (JP); Mitsuhisa Fujita, Chousei (JP)

(73) Assignee: Hitachi, Ltd., Tokyo (JP)

( * ) Notice: Subject to any disclaimer, the term of this patent is extended or adjusted under 35 U.S.C. 154(b) by 236 days.

(21) Appl. No.: 10/122,206

(22) Filed: Apr. 16, 2002

(65) Prior Publication Data

US 2002/0154083 A1 Oct. 24, 2002

(30) Foreign Application Priority Data

Apr. 19, 2001 (JP) ..... 2001-120795

(51) Int. Cl.
*G09G 3/36* (2006.01)

(52) U.S. Cl. ..... 345/89; 345/690

(58) Field of Classification Search ..... 345/103, 345/690–693, 89, 77, 98–100
See application file for complete search history.

(56) References Cited

U.S. PATENT DOCUMENTS 4,975,691 A * 12/1990 Lee ..... 345/79
5,250,931 A * 10/1993 Misawa et al. ..... 345/206
5,731,802 A * 3/1998 Aras et al. ..... 345/692
6,057,824 A * 5/2000 Katakura et al. ..... 345/100
6,351,077 B1 * 2/2002 Koyama ..... 315/169.3

FOREIGN PATENT DOCUMENTS

JP 2002-100709 4/2001

* cited by examiner

*Primary Examiner*—Alexander Eisen
(74) *Attorney, Agent, or Firm*—Antonelli, Terry, Stout and Kraus, LLP.

(57) ABSTRACT

A display device has a matrix array of pixels, each provided with a switching element operated by a scanning signal and a pixel electrode supplied with a video signal via the switching element. A method of driving a display device includes selecting of a row of pixels successively in a matrix array of pixels, and supplying of a video signal to each of the selected pixels. A gray scale is produced by writing binary signals into each of the pixels at plural times within one field period, based upon information represented by plural bits. The writing of binary signals is performed by turning on the switching element for one of plural approximately equal portions into which a unit basic scanning period is divided, the unit basic scanning period being a subdivision of one field period, and time intervals between the plural times are selected to be successively shorter.

7 Claims, 8 Drawing Sheets

DISPLAY DEVICE AND METHOD OF DRIVING SAME

BACKGROUND OF THE INVENTION

The present invention relates to a display device and a method of driving the display device, and, for example, to a liquid crystal display device of the so-called active matrix type and a method of driving the liquid crystal display device.

In an active matrix type liquid crystal display device, a liquid crystal layer is sandwiched between a pair of opposing substrates, formed on a liquid-crystal-layer-side surface of one of the pair of substrates are a plurality of gate signal lines extending in an x direction and arranged in a y direction, and a plurality of drain signal lines extending in the y direction and arranged in the x direction, and each of a plurality of pixel areas is defined by two adjacent ones of the gate signal lines and two adjacent ones of the drain signal lines.

Each pixel area is provided with a switching element driven by a scanning signal via a gate signal line, and is provided with a pixel electrode supplied with a video signal via the switching element from a drain signal line. The respective gate signal lines are successively selected by the scanning signals, and the respective signal lines are supplied with video signals in synchronism with the selection of the gate signal lines such that images are produced in a liquid crystal display section formed by a plurality of pixel areas.

There are various techniques for displaying gray scales at each of the pixels of such liquid crystal display devices. One is to vary the amplitude of a voltage applied to a pixel in accordance with a desired gray scale level, and this technique is widely used in present liquid crystal display devices employing TFTs (Thin Film Transistors). Another technique is PWM (Pulse Width Modulation) which reproduces a gray scale representation by varying the duration of a pulse applied to a pixel while the amplitude of the pulse is kept constant.

SUMMARY OF THE INVENTION

Various methods have been proposed for implementing PWM, and some are put into practice, but all of them adopt a method of dividing a time required for forming a picture, which is called a field, into a plurality of subfields in some mode or other, to achieve scanning at a higher speed.

Consider a method of dividing a field into a plurality of subfields each corresponding to one of a plurality of bits representing a gray scale signal. As an example, there is a method in which a period of time assigned to each of the subfields is kept constant. Suppose the gray scale signal is composed of six bits and the sixth bit (the most significant bit) represents one full subfield, then a half subfield assigned to the fifth bit, three fourths of the subfield assigned to the fourth bit, seven eighths of the subfield assigned to the fourth bit, . . . are wasted, and this wasted time increases with lower bit position.

On the other hand, consider a case in which the length of time of a subfield is varied in accordance with the length of time represented by each of the bits representing a gray scale signal. Suppose that a subfield is one (1), then a length of time of a subfield assigned to the sixth bit is ½, a length of time of a subfield assigned to the fifth bit is ¼, . . . , a length of time of a subfield assigned to the first bit is 1/64. Consequently, it is necessary to increase a scanning speed of the display screen and an operating speed of an input signal processing circuit by a factor of 64 for writing of the first bit data.

The present invention has been made in view of the above circumstances, and it is an object of the present invention to provide a display device and a method of driving the display device.

The following explains the representative ones of the present inventions disclosed in this specification briefly.

In accordance with an embodiment of the present invention, there is provided a method of driving a display device comprising selecting of a row of pixels successively in a matrix array of pixels, and supplying of a video signal to each of the selected pixels, wherein a gray scale is produced by writing binary signals into each of pixels at a plurality of times within one field period, based upon a plurality of bits, and time intervals between the plurality of times are selected to be successively shorter.

In accordance with another embodiment of the present invention, there is provided a method of driving a display device comprising selecting of a row of pixels successively in a matrix array of pixels, and supplying of a video signal to each of the selected pixels, wherein a gray scale is produced by writing binary signals into each of pixels at n times within one field period, based upon n bits, and time intervals between the n times are selected to be successively shorter by a factor of approximately 2.

In accordance with another embodiment of the present invention, there is provided a method of driving a display device comprising selecting a row of pixels in a matrix array of pixels, and supplying a video signal to each of the selected pixels, the video signal being a binary signal corresponding to one bit of n bit data representing a gray scale, wherein n pixel rows forming one of a plurality of groups are selected successively in a first columnwise direction within one of unit basic scanning periods, each of the plurality of groups being formed of n pixel rows arranged to be spaced from a preceding pixel row thereof by rows successively smaller in number by a factor of approximately 2, the unit basic scanning periods being a subdivision of one field period, then n pixel rows forming another one of the plurality of groups moved by one row in a second columnwise direction opposite from the first columnwise direction are selected successively in the first columnwise direction within another one of the unit basic scanning periods succeeding the one thereof, thereafter the successive selecting of n pixel rows forming one of the plurality of groups is repeated by moving one row at a time in the second columnwise direction, each of n pixel rows forming each of the plurality of groups is supplied with a binary signal corresponding to a different bit position of the n bit data, respectively, within a corresponding one of the unit basic scanning periods.

In accordance with another embodiment of the present invention, there is provided a method of driving a display device comprising selecting a row of pixels in a matrix array of pixels, and supplying a video signal to each of the selected pixels, the video signal being a binary signal corresponding to one bit of n bit data representing a gray scale, wherein n pixel rows forming one of a plurality of groups are selected successively in a first columnwise direction, each of the plurality of groups being formed of n pixel rows arranged to be spaced from a preceding pixel row thereof by rows successively smaller in number by a factor of approximately 2, then n pixel rows forming another one of the plurality of groups moved by one row in a second columnwise direction opposite from the first columnwise direction are selected successively in the first columnwise direction, thereafter the successive selecting of n pixel rows forming one of the plurality of groups is repeated by moving one row at a time in the second columnwise direction, and each of n pixel rows forming each of the plurality of groups is supplied with a binary signal corresponding to a different bit position of the n bit data, respectively.

In accordance with another embodiment of the present invention, there is provided a display device which selects a row of pixels in a matrix array of pixels, and supplies a video signal to each of the selected pixels, the video signal producing a gray scale represented by n bit data, the display device comprising: a scanning drive circuit for selecting successively n pixel rows forming one of a plurality of groups in a first columnwise direction within one of unit basic scanning periods, each of the plurality of groups being formed of n pixel rows arranged to be spaced from a preceding pixel row thereof by rows successively smaller in number by a factor of approximately 2, the unit basic scanning periods being a subdivision of one field period, then selecting n pixel rows forming another one of the plurality of groups moved by one row in a second columnwise direction opposite from the first columnwise direction, successively in the first columnwise direction within another one of the unit basic scanning periods succeeding the one thereof, thereafter repeating the successive selecting of n pixel rows forming one of the plurality of groups by moving one row at a time in the second columnwise direction; and a video signal drive circuit for supplying binary signals to respective ones of n pixel rows forming each of the plurality of groups, within a corresponding one of the unit basic scanning periods, the binary signals corresponding to different bit positions of the n bit data, respectively.

In accordance with another embodiment of the present invention, there is provided a liquid crystal display device comprising a pair of opposing substrates, a liquid crystal layer sandwiched between the pair of substrates, a plurality of gate signal lines extending in one direction and arranged in another direction intersecting the one direction on a liquid-crystal-layer side surface of one of the pair of opposing substrates, a plurality of drain signal lines arranged to intersect the plurality of gate signal lines, a plurality of pixel areas each surrounded by two adjacent ones of the plurality of gate signal lines and two adjacent ones of plurality of drain signal lines, each of the plurality of pixel areas being provided with a switching element operated by a scanning signal from one of the plurality of gate signal lines, and a pixel electrode supplied with a video signal from one of the plurality of drain signal lines via the switching element, a scanning drive circuit for scanning successively a plural number of gate signal lines forming one of a plurality of groups, among the plurality of gate signal lines, in a first direction in parallel with the another direction within a unit scanning period, each of the plurality of groups being formed of the plural number of gate signal lines arranged to be spaced from a preceding gate signal line thereof by lines successively smaller in number by a factor of approximately 2, then scanning the plural number of gate signal lines forming another one of the plurality of groups moved by one gate signal line in a second direction opposite from the first direction, successively in the first direction within another unit scanning period succeeding the one unit scanning period, thereafter repeating the successive selecting of the plural number of gate signal lines forming one of the plurality of groups by moving one gate signal line at a time in the second direction; and a video signal drive circuit supplied with n-bit display data representing a gray scale for each pixel and supplying binary signals to respective ones of the plurality of drain signal lines in synchronism with the successive scanning of the plural number of gate signal lines within a corresponding one of the unit scanning periods, the binary signals corresponding to different bit positions of the n bit data, respectively.

In accordance with another embodiment of the present invention, there is provided a liquid crystal display device comprising a pair of opposing substrates, a liquid crystal layer sandwiched between the pair of substrates, a plurality of gate signal lines extending in one direction and arranged in another direction intersecting the one direction on a liquid-crystal-layer side surface of one of the pair of opposing substrates, a plurality of drain signal lines arranged to intersect the plurality of gate signal lines, a plurality of pixel areas each surrounded by two adjacent ones of the plurality of gate signal lines and two adjacent ones of plurality of drain signal lines, each of the plurality of pixel areas being provided with a switching element operated by a scanning signal from one of the plurality of gate signal lines, and a pixel electrode supplied with a video signal from one of the plurality of drain signal lines via the switching element, a scanning drive circuit for scanning successively a plural number of gate signal lines forming one of a plurality of groups, among the plurality of gate signal lines, in a first direction in parallel with the another direction within a unit scanning period, each of the plurality of groups being formed of the plural number of gate signal lines arranged to be spaced from a preceding gate signal line thereof by lines successively smaller in number by a factor of approximately 2, then scanning the plural number of gate signal lines forming another one of the plurality of groups moved by one gate signal line in a second direction opposite from the first direction, successively in the first direction within another unit scanning period succeeding the one unit scanning period, thereafter repeating the successive selecting of the plural number of gate signal lines forming one of the plurality of groups by moving one gate signal line at a time in the second direction; a video signal drive circuit supplied with n-bit display data representing a gray scale for each pixel from a field memory and supplying binary signals to respective ones of the plurality of drain signal lines in synchronism with the successive scanning of the plural number of gate signal lines within a corresponding one of the unit scanning periods, the binary signals corresponding to different bit positions of the n bit data, respectively; and the field memory storing in a plurality of cells thereof n-bit information representing gray scales to be written into pixels, and outputting corresponding n-bit information in synchronism with the successive scanning of the plurality of gate signal lines.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Embodiments of a liquid crystal display device in accordance with the present invention will be explained by reference to the drawings.

Embodiment 1

Figures 4A, 4B:
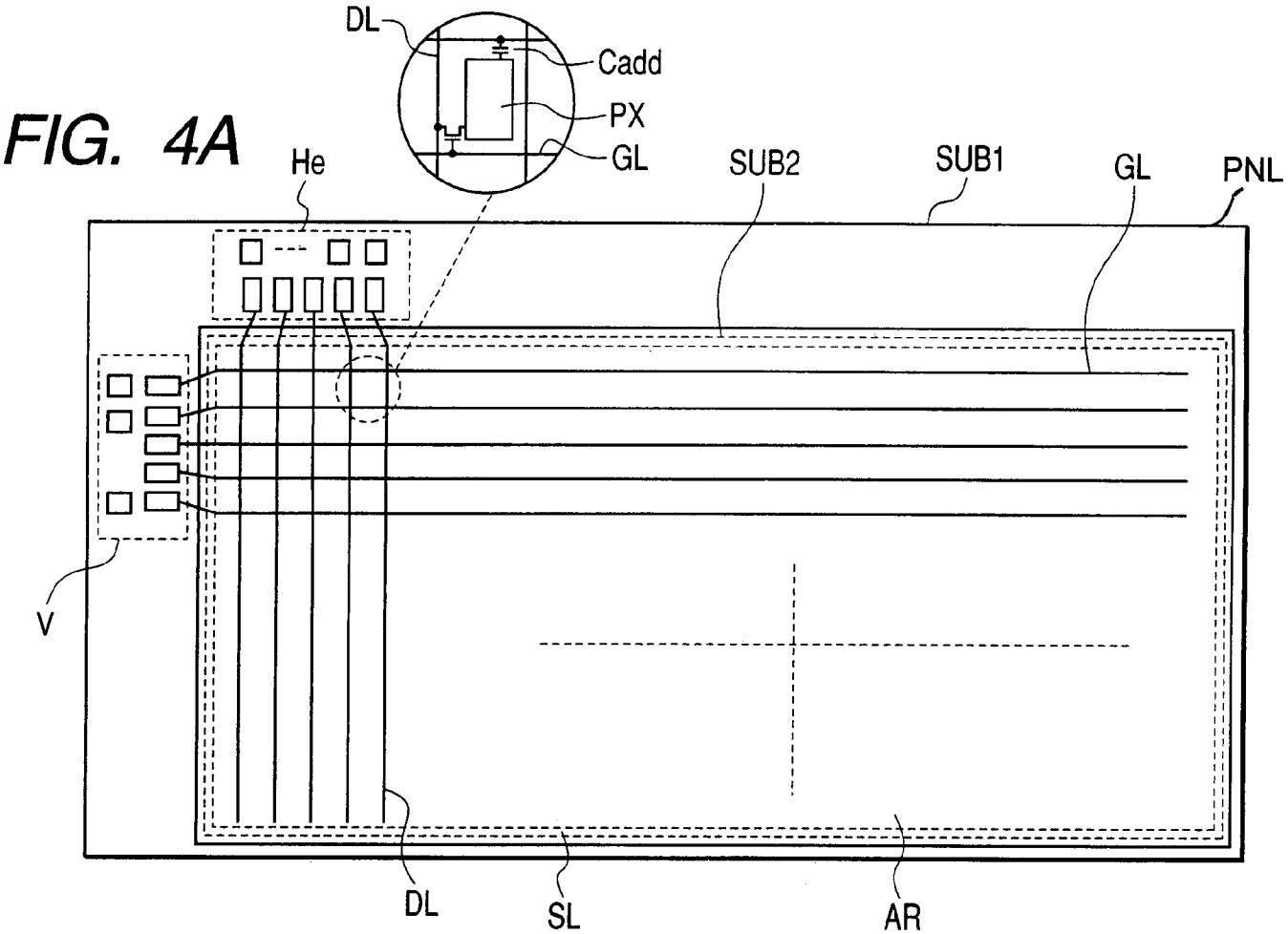
FIG. 4A is a plan view of a liquid crystal display panel illustrated as an embodiment of the display device in accordance with the present invention.
FIG. 4B is an enlarged view of an indicated portion of the liquid crystal display panel of FIG. 4A.

FIGS. 4A and 4B illustrate a liquid crystal display panel of a liquid crystal display device in accordance with the present invention.

The liquid crystal display panel PNL shown in FIG. 4A comprises a pair of opposing transparent substrates SUB1 and SUB2, a liquid crystal layer sandwiched between the substrates SUB1 and SUB2. The two substrates SUB1 and SUB2 are fixed together by a sealing member SL which serves to seal up the liquid crystal layer therebetween.

Formed on a liquid-crystal-layer side surface of the transparent substrate SUB1 and surrounded by the sealing member SL are a plurality of gate signal lines GL extending in an x direction and arranged in a y direction and a plurality of drain signal lines DL extending in the y direction and arranged in the x direction.

Each of areas surrounded by two adjacent ones of the gate signal lines GL and two adjacent ones of the drain signal lines DL forms one pixel area as shown in FIG. 4B, and a matrix array of the pixel areas form a liquid crystal display section AR.

Each of the pixel areas is provided with a thin film transistor TFT driven by a scanning signal from a corresponding one of the gate signal lines GL, and a pixel electrode PX supplied with a video signal via the thin film transistor TFT from a corresponding one of the drain signal lines DL. The pixel electrode PX generates an electric field between the pixel electrode PX and a counter electrode (not shown) formed on a liquid-crystal-layer side surface of the other transparent substrate SUB2 and thereby controls light transmission through the liquid crystal layer.

As shown in FIG. 4B, a capacitance element Cadd is formed between the pixel electrode PX and another gate signal line GL adjacent to the gate signal line GL for driving the pixel electrode PX. This capacitance element Cadd is intended to retain a video signal supplied to the pixel electrode PX for a longer time.

An end of each of the gate signal lines GL extends beyond the sealing member SL, and serves as a terminal to be connected to a corresponding one of output terminals of a vertical scanning drive circuit v, input terminals of which are supplied with signals from a printed circuit board disposed outside the liquid crystal display panel.

The vertical scanning drive circuit V is composed of a plurality of semiconductor devices, and the gate signal lines GL are divided into a plurality of groups each comprising a certain number of adjacent ones of the gate signal lines, and one of the semiconductor devices of the vertical scanning drive circuit V is assigned to each of the groups.

An end of each of the drain signal lines DL extends beyond the sealing member SL, and serves as a terminal to be connected to a corresponding one of output terminals of a video signal drive circuit He, input terminals of which are supplied with signals from a printed circuit board disposed outside the liquid crystal display panel.

The video signal drive circuit He is also composed of a plurality of semiconductor devices and the drain signal lines DL are divided into a plurality of groups each comprising a certain number of adjacent ones of the drain signal lines DL, and one of the semiconductor devices of the video signal drive circuit He is assigned to each of the groups.

Each of the gate signal lines GL is selected by a scanning signal from the vertical scanning circuit V, and in synchronism with this selection, video signals are supplied to respective ones of the drain signal lines DL from the video signal drive circuit He.

Suppose that gray scales produced at each pixel is represented by a three-bit information (data) as an example. The following explains the procedure of supplying scanning signals to the respective gate signal lines GL from the vertical scanning drive circuit V and supplying video signals to the respective drain signal lines DL from the video signal drive circuit He in synchronism with the scanning signals, by reference to FIGS. 1 to 3.

Figure 1:
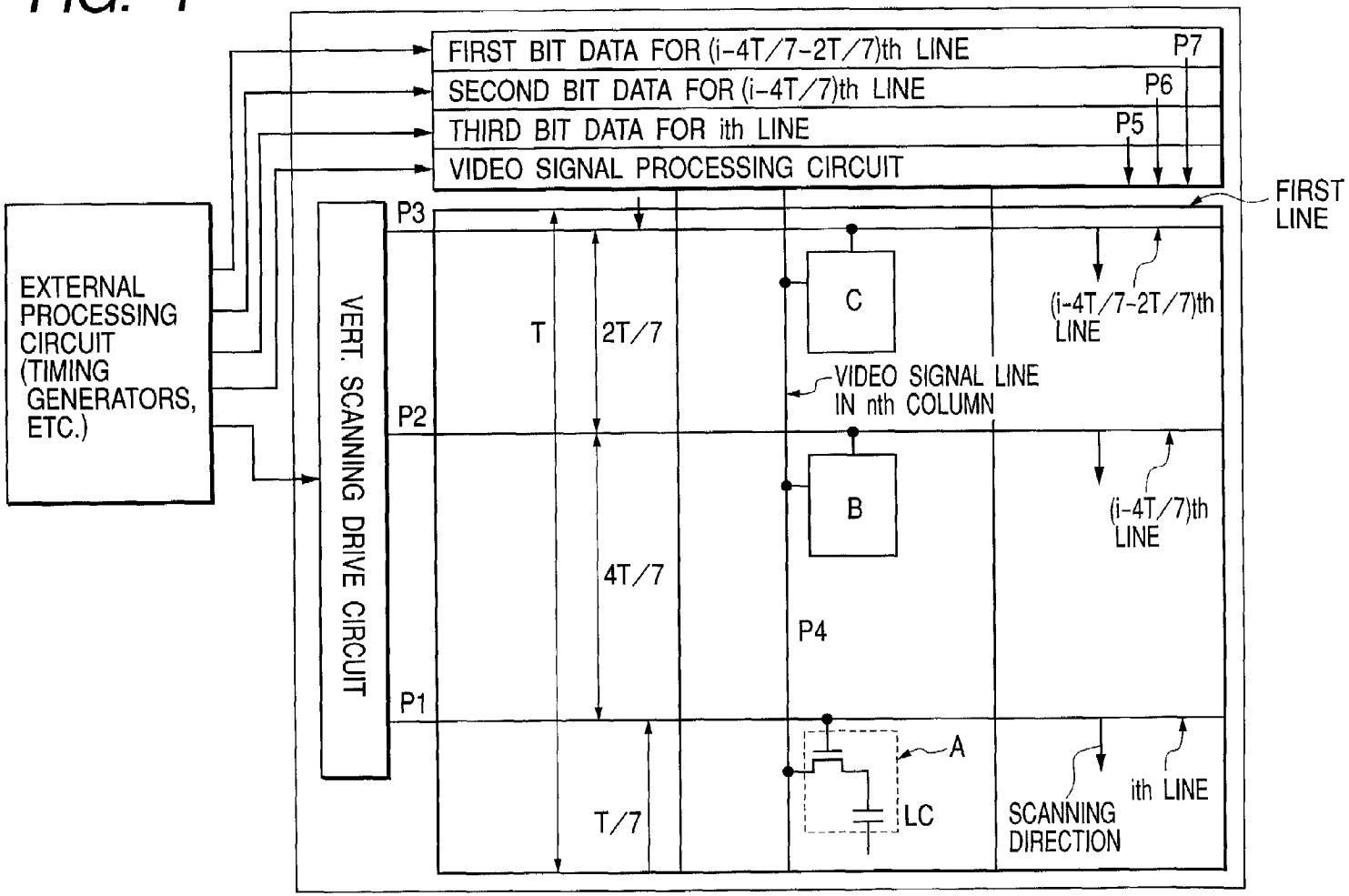
FIG. 1 is an illustration for explaining an embodiment of a display device and a method of driving the display device in accordance with the present invention.

FIG. 1 illustrates three of the gate signal lines GL selected during a unit basic scanning period U, where the unit basic scanning period U is a field period divided by T which is the number of lines of actual pixels plus the number of imaginary lines obtained by dividing a vertical retrace period (a blanking period) by the unit basic scanning period U.

As shown in FIG. 1, selected during a given unit basic scanning period are the ith gate signal line GL, (i−4T/7)th gate signal line GL, and (i−4T/7−2T/7)th gate signal line GL.

In the following explanation, for simplicity, the vertical retrace period is chosen to be an integral multiple of the unit basic scanning period U, and T is chosen to be an integral multiple of $(2^3-1)$, i.e., 7. The reason why $(2^3-1)$ is adopted is that three-bit data can represent eight gray scale levels by assigning numbers 0, 1, 2, 3, 4, 5, 6 and 7 to the respective gray scale levels.

Figure 2:
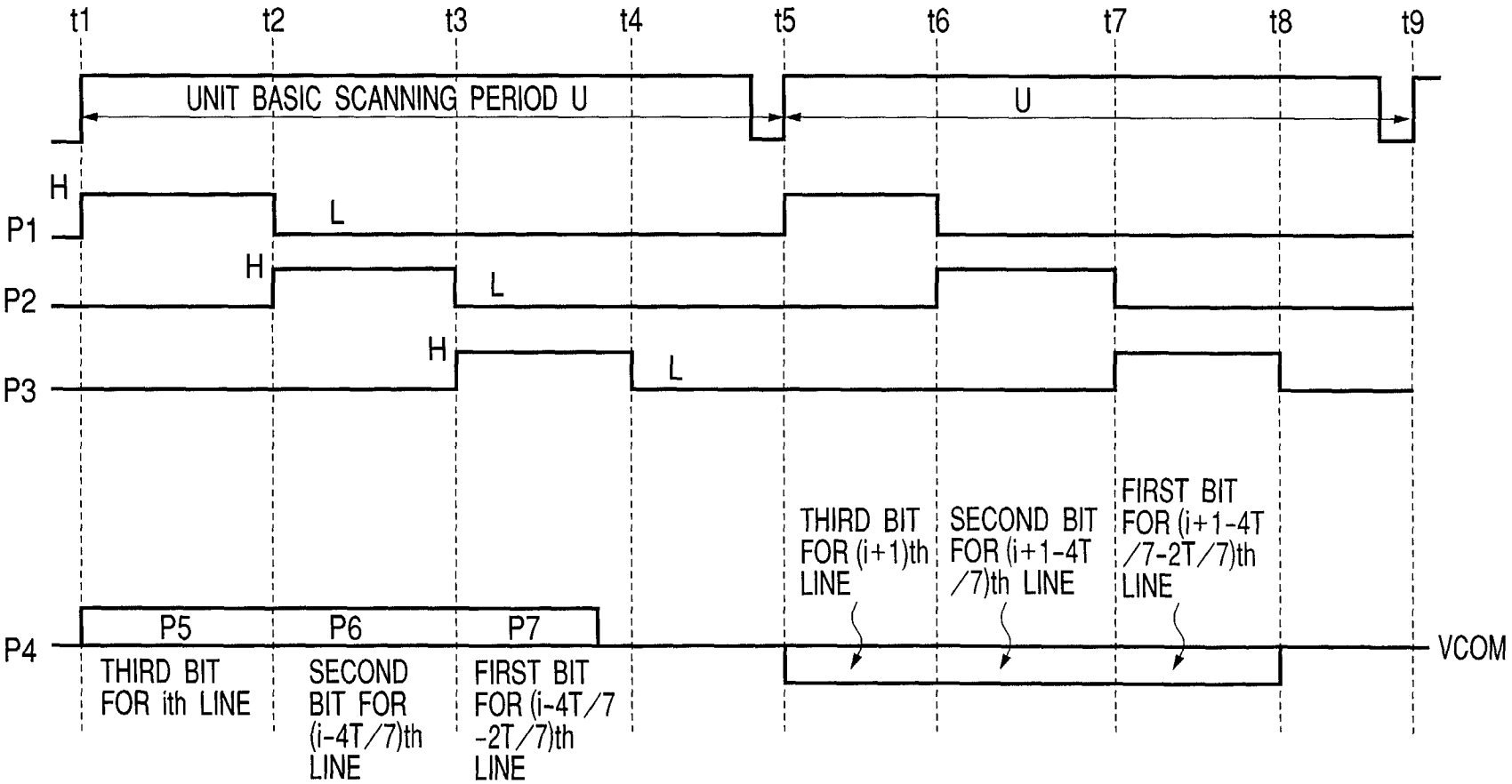
FIG. 2 is a timing chart illustrating an example of a scanning sequence of gate signal lines in the display device and the method of driving the display device in accordance with the present invention.

As shown in FIG. 2, the ith, (i−4T/7)th, and (i−4T/7−2T/7)th gate signal lines GL are selected successively during time from t1 to 2, time from t2 to t3, and time from t3 to t4, respectively. Then, in the next succeeding unit basic scanning period U, the (i+1)th, (i+1−4T/7)th, and (i+1−4T/7−2T/7)th gate signal lines GL, succeeding the ith, (i−4T/7)th, and (i−4T/7−2T/7)th gate signal lines GL, respectively, are selected successively during time from t5 to 6, time from t6 to t7, and time from t7 to t8, respectively.

The above-explained supply of the scanning signals to the respective gate signal lines GL by the vertical scanning drive circuit V is controlled by an external processing circuit shown in FIG. 1, which transfers data to the video signal drive circuit He (see FIG. 4A). The external processing circuit also controls the video signal drive circuit He such that it transfers video signals to the respective drain signal lines DL in synchronism with the supply of the scanning signals.

Figure 3:
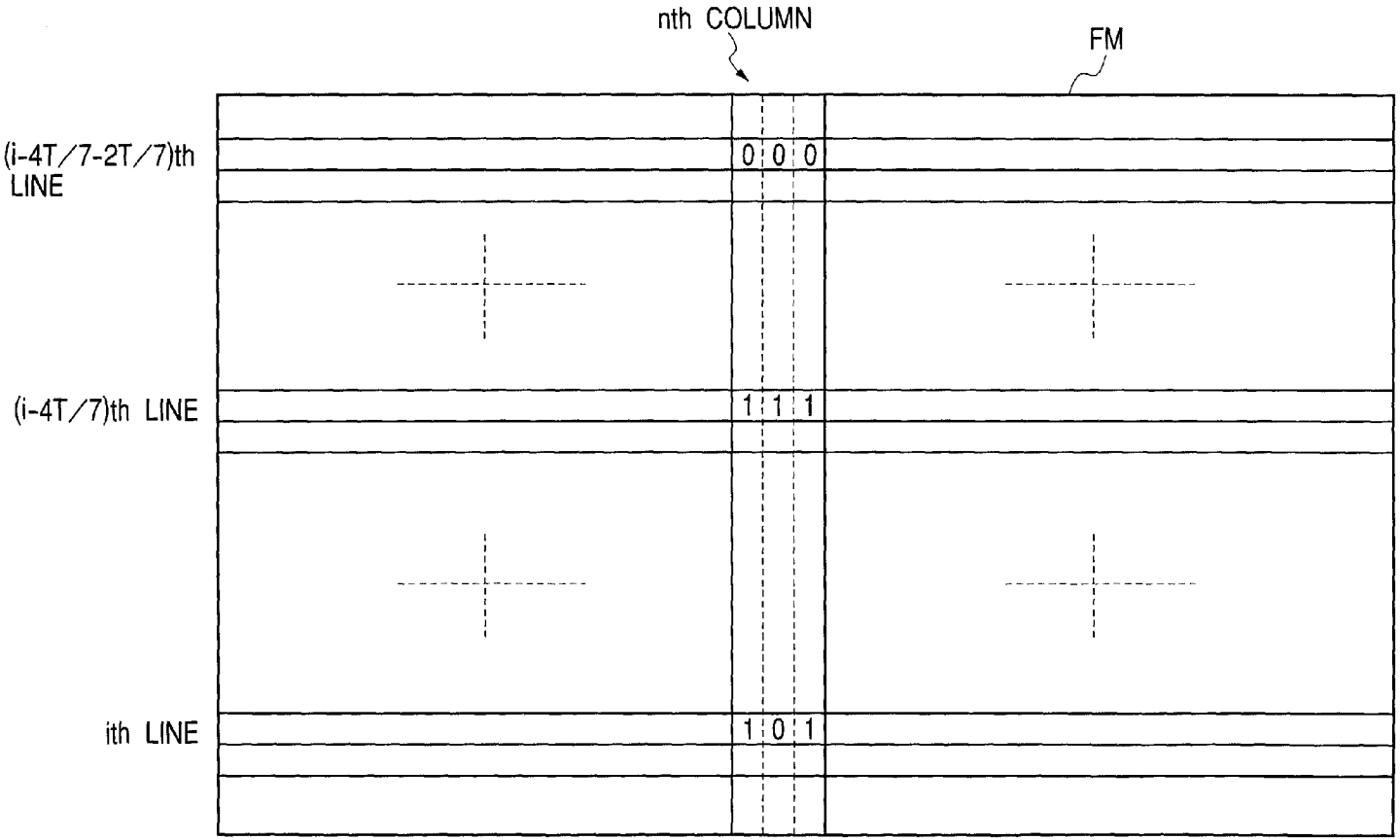
FIG. 3 is an illustration of an example of a method of storing display data in a field memory provided in an external processing circuit of the display device in accordance with the present invention.

The external processing circuit is supplied with color information data corresponding to red, green and blue signal inputs intended for standard CRTs (Cathode Ray Tubes), and the color information data is stored in a field memory FM illustrated in FIG. 3. The field memory FM is configured such that each of its cells corresponding to one of the pixel areas of the liquid crystal display panel stores pixel information to be written into the one of the pixel areas. In this embodiment, the pixel information stored in each cell of the field memory FM is configured so as to represent gray scales by using three-bit data, and therefore, in the case shown in FIG. 3, information (1, 0, 1) is stored in an ith cell in an nth column which corresponds to an ith pixel area in an nth column of the liquid crystal display panel.

For purpose of illustration, in FIG. 3, it has also been assumed that information (1, 1, 1) and information (0, 0, 0) are stored in a (i−4T/7)th cells in the nth column and a (i−4T/7−2T/7)th cell in the nth column, respectively. Stored in other cells of the field memory FM are information to be written into corresponding pixel areas of the liquid crystal display panel, but they are omitted in FIG. 3.

The explanation here will be limited to the information stored in the nth column of the field memory FM having such information stored therein by way of an example. Prior to the above-explained unit basic scanning period U, t1 to t5, the third bit data "1", of the information (1, 0, 1) in the ith cell, the second bit data "1" of the information (1, 1, 1) in the (i−4T/7)th cell, and the first bit data "0" of the information (0, 0, 0) in the (i−4T/7−2T/7)th cell have been transferred successively to the video signal drive circuit He. Information for the remaining columns as well as that for the nth column is transferred to the video signal drive circuit He in the same way.

In the above-explained unit basic scanning period U, during time from t1 to t2 when the ith gate signal line GL is selected, the above-mentioned information "1" is supplied to the pixel electrode PX of the ith pixel area in the nth column via the drain signal line DL from the video signal drive circuit He, and thereafter during time from t2 to t3 when the (i−4T/7)th gate signal line GL is selected, the above-mentioned information "1" is supplied to the pixel electrode PX of the (i−4T/7)th pixel area in the nth column via the drain signal line DL from the video signal drive circuit He, and then, during time from t3 to t4 when the (i−4T/7−2T/7)th gate signal line GL is selected, the above-mentioned information "0" is supplied to the pixel electrode PX of the (i−4T/7−2T/7)th pixel area in the nth column via the drain signal line DL from the video signal drive circuit He. Thereafter, during the next succeeding unit basic scanning period U, t5 to t8, the (i+1)th, (i+1−4T/7)th, and (i+1−4T/7−2T/7)th gate signal lines GL are selected successively, the similar operation is repeated.

Figure 8:
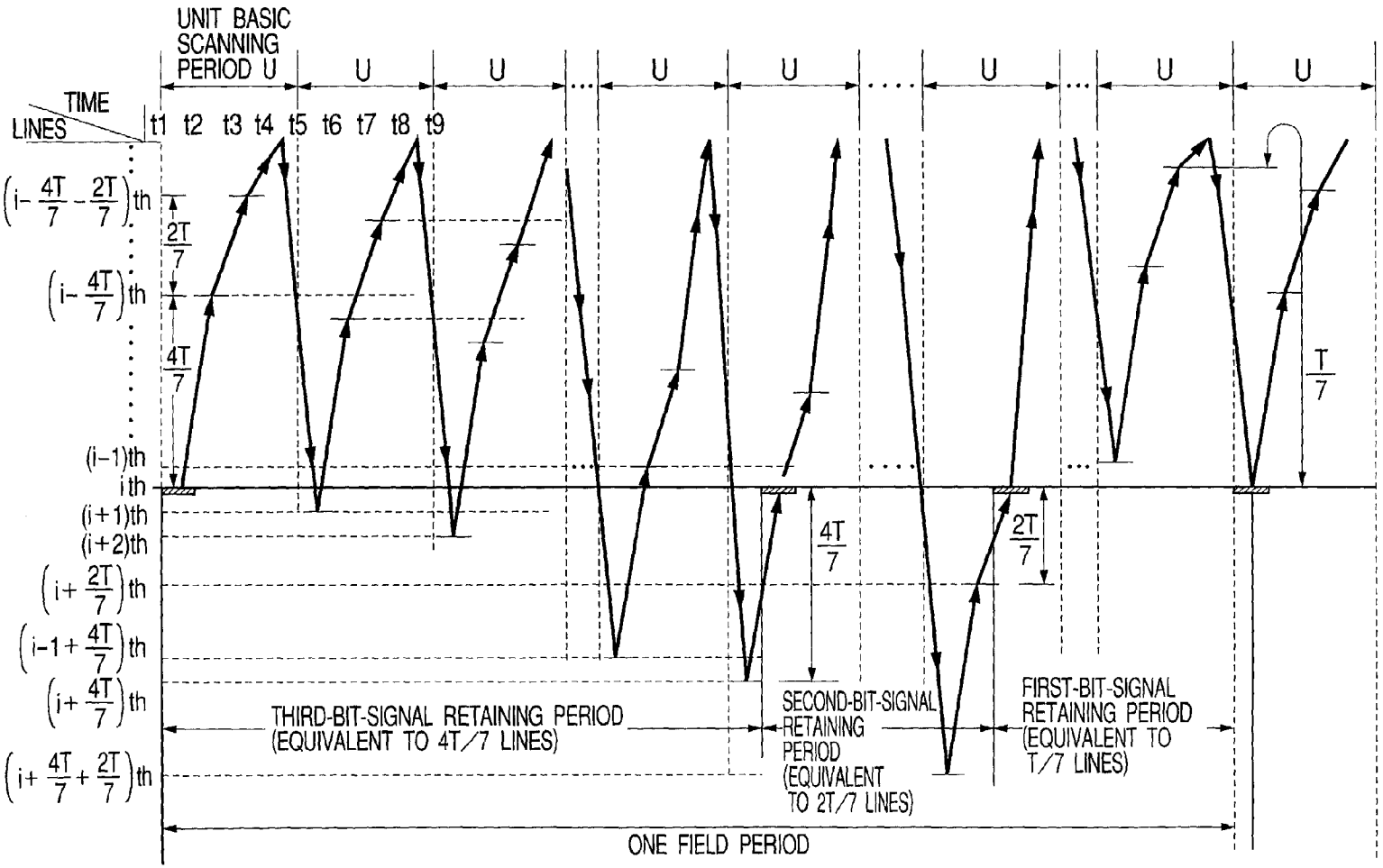
FIG. 8 is a detailed illustration of a scanning sequence of gate signal lines and signal retaining periods during one field period in the display device and the method of driving the display device in accordance with the present invention.

As illustrated in FIG. 8, in this embodiment, a triplet of gate signal lines GL are selected within the unit basic scanning period U. A first triplet-forming gate signal line GL is the ith gate signal line GL, a second triplet-forming gate signal line GL is the (i−4T/7)th gate signal line GL, and a third triplet-forming gate signal line GL is the (i−4T/7−2T/7)th gate signal line GL.

Consequently, each of the gate signal line GL is selected at three times in one field period as shown in FIG. 8. Take the ith gate signal line GL, for example. First, the ith gate signal line GL is selected as a first triplet-forming gate signal line GL, and then, after the (i+4T/7)th gate signal line GL is selected as a first triplet-forming gate signal line GL, the ith gate signal line GL is again selected as a second triplet-forming gate signal line GL, and then, after the (i+2T/7)th gate signal line GL is selected as a second triplet-forming gate signal line GL, the ith gate signal line GL is again selected as a third triplet-forming gate signal line GL.

Now focus attention on operation of the ith pixel area in the nth column in the above operating sequence.

The (i−4T/7)th gate signal line GL has been selected as the second triplet-forming gate signal line GL during the above-mentioned unit basic scanning period U, time from t1 to t5, and thereafter the second triplet-forming gate signal line GL moves downward successively line by line, and after a period of time equivalent to 4T/7 lines, the ith gate signal line GL is selected again. In this case, the second bit data "0" stored in the ith cell in the nth column of the field memory FM shown in FIG. 3 is supplied to the pixel electrode PX of the pixel area via the video signal drive circuit He. The information "1" has been written in the pixel electrode PX, but at this time the information "1" is replaced with the information "0."

Now focus attention again on operation of the ith pixel area in the nth column.

The (i−4T/7−2T/7)th gate signal line GL has been selected as the third triplet-forming gate signal line GL during the above-mentioned unit basic scanning period U, time from t1 to t5, and thereafter the third triplet-forming gate signal line GL moves downward successively line by line, and after a period of time equivalent to (4T/7+2T/7) lines, the ith gate signal line GL is selected again. In this case, the first bit data "1" stored in the ith cell in the nth column of the field memory FM shown in FIG. 3 is supplied to the pixel electrode PX of the pixel area via the video signal drive circuit He. The information "0" has already been written in the pixel electrode PX, but at this time the information "0" is replaced with the information "1."

In this way, the information "1", "0" and "1" have been written successively into the ith pixel area in the nth column, and the viewer recognizes the amount of light integrated based upon the information as a gray scale level. In this case, the interval of time after the first information "1" has been written until the second information "0" is written is equivalent to 4T/7 lines, the interval of time after the second information "0" has been written until the third information "1" is written is equivalent to 2T/7lines, and the time of interval after the third information "1" until next information is written is equivalent to T/7 lines.

As explained above in connection with FIG. 8, selection of the gate signal lines GL during each unit basic scanning period U is such that first a first triplet-forming gate signal line GL is selected, then a second triplet-forming gate signal line GL spaced from the first triplet-forming gate signal line GL by the 4T/7 lines is selected, and thereafter a third triplet-forming gate signal line GL spaced from the second triplet-forming gate signal line GL by the 2T/7 lines is selected, in accordance with the respective intervals of time between writing of the data.

With this configuration, the first information (the third-bit information) "1" is retained for a length of time $2^{3-1}\times K$, the second information (the second-bit information) "0" is retained for a length of time $2^{2-1}\times K$, and the third information (the first-bit information) "1" is retained for a length of time $2^{1-1}\times K$, where k is a constant of proportionality. Such operation is performed in the remaining pixel areas.

The operation during the time from t1 to t5 will be explained by focusing attention on an ith pixel area A in the n-th column indicated in FIG. 1 by reference to a time chart shown in FIG. 2.

(1) First at time t1, a pulse P1 indicated in FIG. 2 goes high and thereby caused the ith gate signal line to go high, and at the same time a potential on the drain signal line DL is determined based upon the third-bit information "1" of the information (1, 0, 1) stored at a corresponding location of the field memory FM (see FIG. 3) of the external processing circuit. In this case, since the bit data is "1," the drain signal line DL is made high. In this way, the first-portion information of the gray scale represented by the three-bit information is written into the pixel A.

(2) Since the scanning signal for the ith gate signal lines GL is at an active level (a high level), all the thin film transistors TFT in this line are in the ON state, potentials on the respective drain signal lines DL are written into the pixels in the corresponding columns. In this case, since the drain signal line DL in the nth column is high, the high level is written into the pixel A in the ith row and the nth column.

(3) At time t2, the pulse P1 goes from high to low, all the thin film transistors TFT in the ith row are turned OFF, and the states having been written in the respective pixels in the ith row are retained until the pixels in the ith row are selected again.

(4) On the other hand, at time t2, a pulse P2 indicated in FIG. 2 causes the (i−4T/7)th gate signal line GL to go high, and thereby the thin film transistors TFT in all the pixels in the (i−4T/7)th row are turned ON. At this time a potential on the drain signal line DL is determined based upon the second-bit information "1" of the information (1, 1, 1) stored at a corresponding location of the field memory FM (see FIG. 3) of the external processing circuit. In this case, since the bit data is "1," the drain signal line DL is made high. In this way, the second-portion information of the gray scale represented by the three-bit information is written into the pixel B.

Incidentally, the first-portion data (the third-bit data information "1") had already been written into the pixel B before the time 2, but at this time the first-portion information was replaced with this second-portion information.

(5) At time t3 when the pulse P2 goes from high to low, all the thin film transistors TFT in the (i−4T/7)th row are turned OFF, and the states having been written in the respective pixels in the (i−4T/7)th row are retained until the pixels in the (i−4T/7)th row are selected again.

(6) At time t3 when a pulse P3 indicated in FIG. 2 causes the (i−4T/7−2T/7)th gate signal line GL to go high, the thin film transistors TFT in all the pixels in the (i−4T/7−2T/7)th row are turned ON. At this time a potential on the drain signal line DL is determined based upon the first-bit information "0" of the information (0, 0, 0) stored at a corresponding location of the field memory FM (see FIG. 3) of the external processing circuit. In this case, since the bit data is "0," the drain signal line DL is made low. In this way, the third-portion information of the gray scale represented by the three-bit information is written into the pixel C. The first-portion data (the third-bit data information "0") and the second-portion data (the second-bit data information "0") had already been written into the pixel C before the time 3, and therefore the viewer recognizes the amount of light integrated based upon the information as a gray scale level.

(7) At time t4 when the pulse P3 goes from high to low, all the thin film transistors TFT in the (i−4T/7−2T/7)th row are turned OFF, and the states having been written in the respective pixels in the (i−4T/7−2T/7)th row are retained until the pixels in the (i−4T/7−2T/7)th row are selected again.

(8) During time from t4 to t5, selection of the gate signal line GL is moved to the (i+1)th gate signal line GL by the vertical scanning drive circuit V, and during the next succeeding unit-basic-scanning-period U from t5 to t9, the pulses P1, P2 and P3 shown in FIG. 2 are supplied successively to the (i+1)th, (i+1−4T/7)th, and (i+1−4T/7−2T/7)th gate signal line GL, respectively.

(9) During the unit basic scanning period U from t5 to t9, operation similar to that explained in (1) to (8) is performed. Each of the pixels in the (i+1)th row is supplied with a voltage in accordance with a third-bit data of its information, each of the pixels in the (i+1−4T/7)th row is supplied with a voltage in accordance with a second-bit data of its information, and each of the pixels in the (i+1−4T/7−2T/7)th row is supplied with a voltage in accordance with a first-bit data of its information.

(10) Thereafter the cycle of the writing operation described above is repeated by moving selection of the gate signal line GL one row downward at a time by using the multiple-output vertical scanning drive circuit V.

Figure 5:
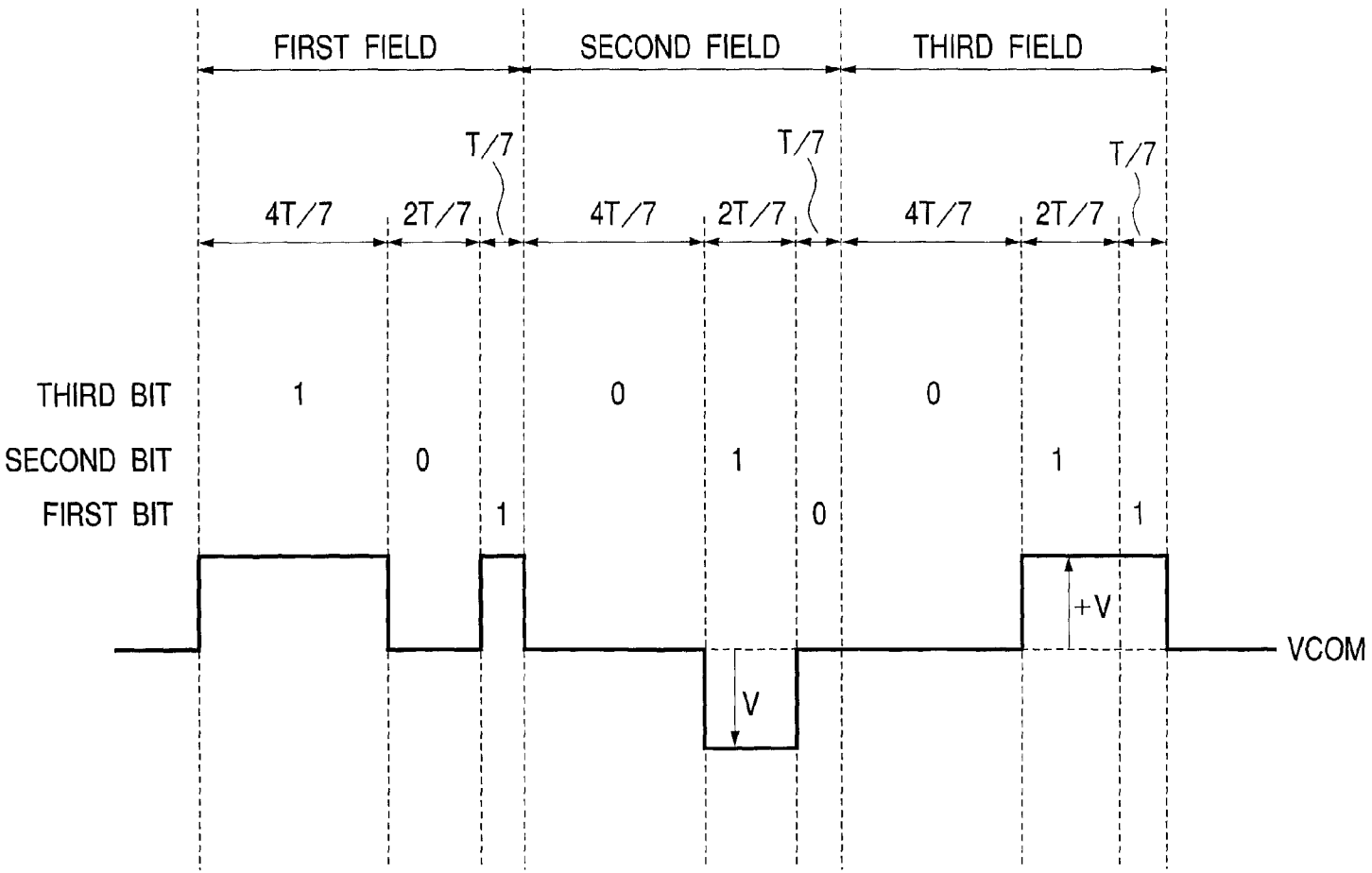
FIG. 5 is a time chart for illustrating a manner in which binary signals representing gray scales are supplied to an arbitrary pixel in the display device in accordance with the present invention.

FIG. 5 is a schematic illustration of variation of the state of the pixel A with time when the above-explained scanning sequence is performed. It is assumed that the pixel A produces gray scales comprising the first field represented by the information (1, 0, 1) as described above, the second and third fields represented by information (0, 1, 0) and (0, 1, 1), respectively.

The three-bit information can represent 0th to seventh gray scale levels, and therefore the pixel A exhibits the first field of the fifth gray scale level represented by (1, 0, 1), the second field of the second gray scale level represented by (0, 1, 0) and the third field of the third gray scale level represented by (0, 1, 1).

Embodiment 2

Figure 6:
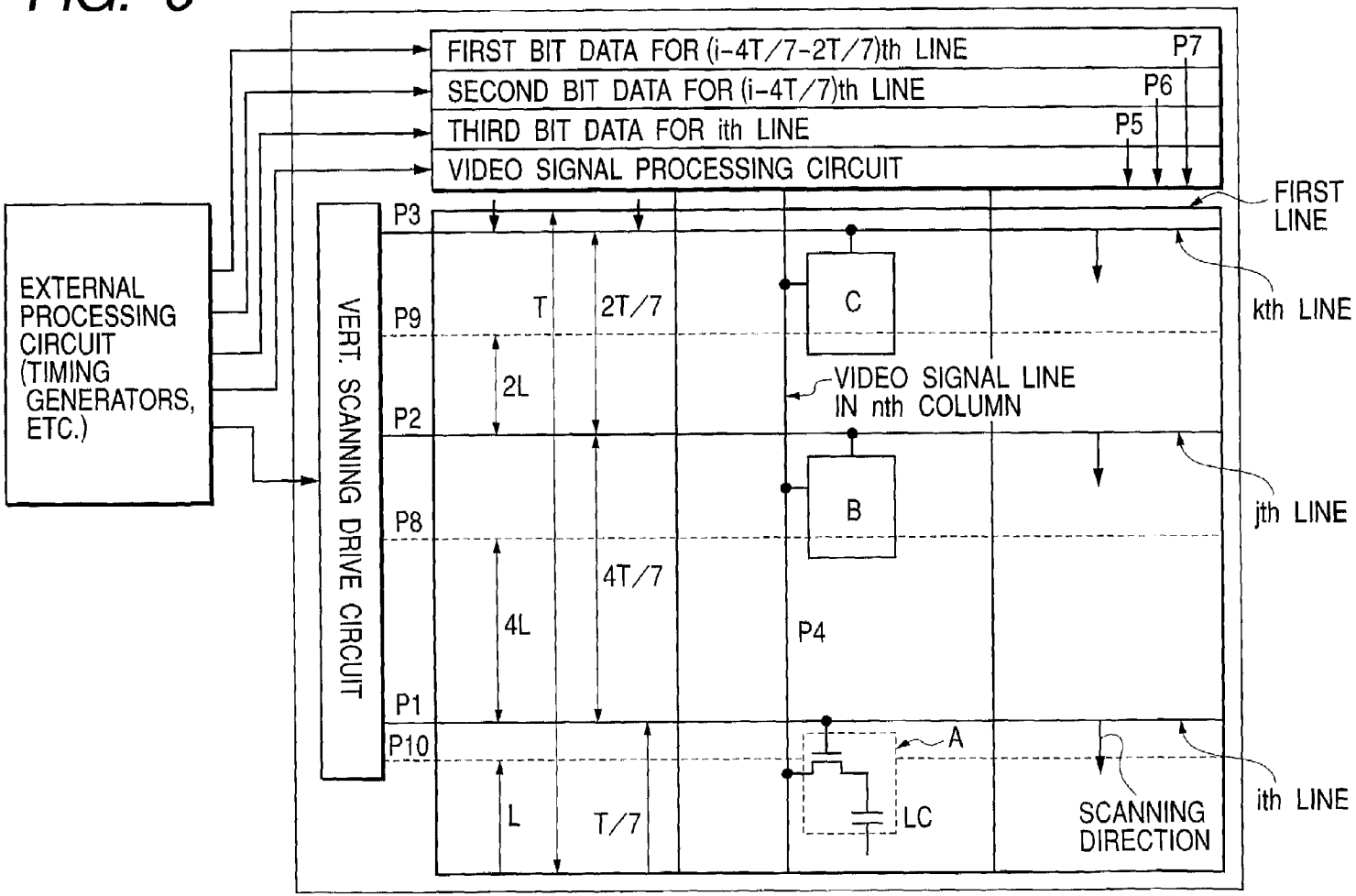
FIG. 6 is an illustration for explaining another embodiment of a display device and a method of driving the display device in accordance with the present invention.
Figure 7:
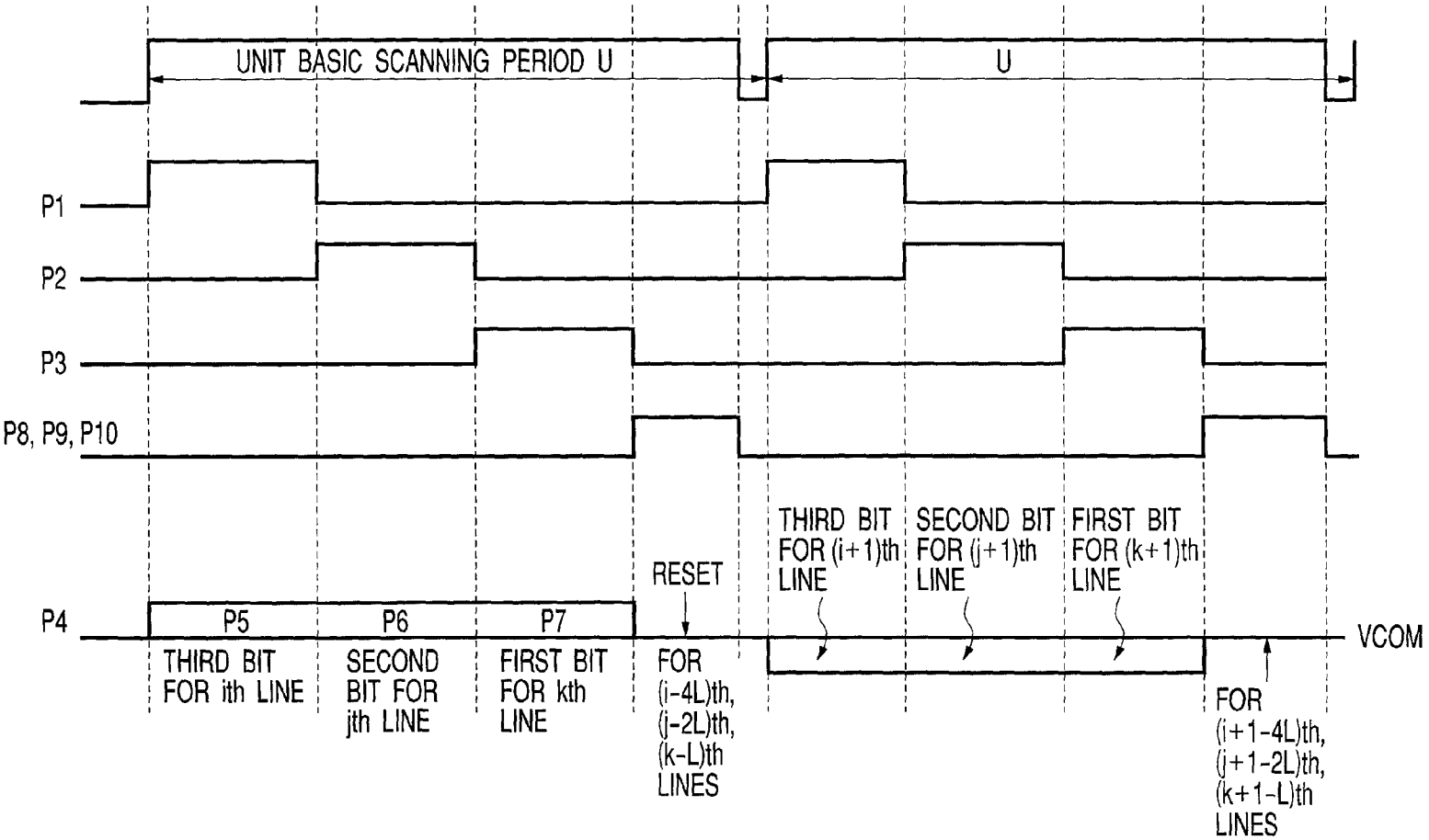
FIG. 7 is a timing chart illustrating an example of a scanning sequence of gate signal lines in the display device and the method of driving the display device of FIG. 6 in accordance with the present invention.

FIGS. 6 and 7 illustrate a configuration and a timing chart therefor similar to those of FIGS. 1 and 2, respectively, illustrating another embodiment of a liquid crystal display device in accordance with the present invention.

This embodiment features addition of selection pulses P8, P9 and P10 for resetting as shown in FIG. 6.

In this embodiment, a triplet of pixel rows written into within the unit basic scanning period U are formed of ith, jth and kth pixel rows, and they are selected to satisfy the following relationship:

$$i-j>4L,$$

$$j-k>2L, \text{ and}$$

$$T-(i-k)>L,$$

where L is the minimum number of rows between the rows of the pixels written into within the unit basic scanning period U.

The reset pulses P8, P9 and P10 are supplied to the (i−4L)th, (i−2L)th and (k−L)th gate signal lines GL, respectively. If the video signal processing circuit sets the video signal lines at a reset potential (for example, a voltage Vcom applied on the counter electrode) when the reset pulses P8, P9 and P10 go high as shown in FIG. 7, all the pixels are reset whose pixel transistors are turned ON by the reset pulses P8, P9 and P10.

Therefore, the pulse widths represented by the third, second and first bit data are 4L, 2L, and L, respectively.

The reset pulses P8, P9 and P10 to be applied to the (i−4L)th, (i−2L)th and (k−L)th gate signal lines GL, respectively, may be made high all at the same time as shown in FIG. 7, or at separate times from each other, during the period when the selection pulses P1, P2 and P3 for writing are low within the specified unit basic scanning period U, and the reset pulses P8, P9 and P10. This operation can be performed during a unused portion of the scanning period (an equivalent time interval between the (i−4L)th and jth rows).

In actual design, in a case where the above-defined total number T of pixel rows is 260, if six-bit data is used, if the sixth, fifth, fourth, third, second and first bit data are assigned to 128, 64, 32, 16, 8 and 4 rows, respectively, the total number of the used rows is 252, and 8 rows remain. Therefore, it is effective to select all the gate signal lines GL for resetting at the same time after a time equivalent to four rows succeeding the first-bit data.

In the above embodiments, the number of times binary signals are written into each pixel within one field time is three, but the present invention is not limited to three, and is also applicable to more than three.

The above embodiments have been explained in connection with the liquid crystal display device, but it is needless to say that the present invention is applicable to other display devices such as an electroluminescent (EL) display device.

As is apparent from the above explanation, the display device and its driving method in accordance with the present invention can achieve the pulse width modulation while the vertical scanning speed is kept as the same as that of scanning one field at one time.

What is claimed is:

1. A method of driving a display device, said display device comprising:

a plurality of gate signal lines extending in one direction and arranged in another direction intersecting said one direction on a substrate;

a plurality of drain signal lines arranged to intersect said plurality of gate signal lines;

a plurality of pixels each surrounded by two adjacent ones of said plurality of gate signal lines and two adjacent ones of said plurality of drain signal lines, each of said plurality of pixels being provided with a switching element operated by a scanning signal from one of said plurality of gate signal lines, and a pixel electrode supplied with a video signal from one of said plurality of drain signal lines via said switching element;

said method comprising selecting pixels of a row of said pixels, and supplying a video signal to each of said selected pixels, said video signal being a binary signal corresponding to one bit of n bit data representing a gray scale, wherein:

n pixel rows forming each of a plurality of groups are selected successively in a first columnwise direction within one of unit basic scanning periods, said each of said plurality of groups is formed of n pixel rows arranged in said each of said plurality of groups to be spaced from a preceding pixel row thereof by rows successively smaller in number by a factor of approximately 2, said unit basic scanning periods being a subdivision of one field period, said selection of n pixel rows is repeated in said first columnwise direction for each subsequent one of said plurality of groups of pixel rows wherein said pixel rows of said each subsequent one of said plurality of groups of pixel rows are shifted in a second columnwise direction, opposite from said first columnwise direction, and each of n pixel rows forming each of said plurality of groups is supplied with a binary signal corresponding to a different bit position of said n bit data, respectively, by turning on ones of said switching elements associated with said each of n pixel rows to select a corresponding one of said plurality of gate signal lines for one of plural approximately equal portions into which a corresponding one of said unit basic scanning periods is divided.

2. A method of driving a display device, said display device comprising:

a plurality of gate signal lines extending in one direction and arranged in another direction intersecting said one direction on a substrate;

a plurality of drain signal lines arranged to intersect said plurality of gate signal lines;

a plurality of pixels each surrounded by two adjacent ones of said plurality of gate signal lines and two adjacent ones of said plurality of drain signal lines, each of said plurality of pixels being provided with a switching element operated by a scanning signal from one of said plurality of gate signal lines, and a pixel electrode supplied with a video signal from one of said plurality of drain signal lines via said switching element;

said method comprising selecting pixels of a row of said pixels, and supplying a video signal to each of said selected pixels, said video signal being a binary signal corresponding to one bit of n bit data representing a gray scale, wherein:

n pixel rows forming each of a plurality of groups are selected successively in a first columnwise direction within a horizontal scanning period, said each of said plurality of groups is formed of n pixel rows arranged in said each of said plurality of groups to be spaced from a preceding pixel row thereof by rows successively smaller in number by a factor of approximately 2.

said selection of n pixel rows is repeated in said first columnwise direction for each subsequent one of said plurality of groups of pixel rows wherein said pixel rows of said each subsequent one of said plurality of groups of pixel rows are shifted in a second columnwise direction, opposite from said first columnwise direction, and each of n pixel rows forming each of said plurality of groups is supplied with a binary signal corresponding to a different bit position of said n bit data, respectively, by turning on ones of said switching elements associated with said each of n pixel rows to select a corresponding one of said plurality of gate signal lines for one of plural approximately equal portions into which said horizontal scanning period is divided.

3. A display device Which selects pixels of a row of pixels in a matrix array of pixels, and which supplies a video signal to each of said selected pixels, said video signal producing a gray scale represented by n bit data, said display device comprising:

a plurality of gate signal lines extending in one direction and arranged in another direction intersecting said one direction on a substrate;

a plurality of drain signal lines arranged to intersect said plurality of gate signal lines;

a plurality of pixels each surrounded by two adjacent ones of said plurality of gate signal lines and two adjacent ones of said plurality of drain signal lines, wherein each of said plurality of pixels is provided with a switching element operated by a scanning signal from one of said plurality of gate signal lines, and a pixel electrode supplied with a video signal from one of said plurality of drain signal lines via said switching element;

a scanning drive circuit for selecting successively n pixel rows forming one of a plurality of groups in a first columnwise direction within one of unit basic scanning periods, wherein said each of said plurality of groups is formed of n pixel rows arranged in said each of said plurality of groups to be spaced from a preceding pixel row thereof by rows successively smaller in number by a factor of approximately 2, said unit basic scanning periods being a subdivision of one field period, said selection of n pixel rows is repeated in said first columnwise direction for each subsequent one of said plurality of groups of pixel rows wherein said pixel rows of said each subsequent one of said plurality of groups of pixel rows are shifted in a second columnwise direction, opposite from said first columnwise direction, and a video signal drive circuit for supplying binary signals to respective ones of n pixel rows forming each of said plurality of groups, with ones of said switching elements associated with said each of n pixel rows being turned on to select a corresponding one of said plurality of gate signal lines for one of plural approximately equal portions into which a corresponding one of said unit basic scanning periods is divided, said binary signals corresponding to different bit positions of said n bit data, respectively.

4. A liquid crystal display device comprising:

a pair of opposing substrates;

a liquid crystal layer sandwiched between said pair of substrates;

a plurality of gate signal lines extending in one direction and arranged in another direction intersecting said one direction on a liquid-crystal-layer side surface of one of said pair of opposing substrates;

a plurality of drain signal lines arranged to intersect said plurality of gate signal lines;

a plurality of pixel areas each surrounded by two adjacent ones of said plurality of gate signal lines and two adjacent ones of said plurality of drain signal lines, each of said plurality of pixel areas being provided with a switching element operated by a scanning signal from one of said plurality of gate signal lines, and a pixel electrode supplied with a video signal from one of said plurality of drain signal lines via said switching element;

a scanning drive circuit for scanning successively a plural number of gate signal lines forming each of a plurality of groups, among said plurality of gate signal lines, in a first direction in parallel with said another direction within one unit scanning period, said unit scanning period being a subdivision of one field period, said each of said plurality of groups being formed of said plural number of gate signal lines arranged in said each of said plurality of groups to be spaced from a preceding gate signal line thereof by lines successively smaller in number by a factor of approximately 2, said scanning of said plural number of gate signal lines is repeated in said first direction for each subsequent one of said plurality of groups of gate signal lines wherein said gate signal lines of said each subsequent one of said plurality of groups of gate signal lines are shifted in a second direction, opposite from said first direction, and a video signal drive circuit supplied with n bit display data representing a gray scale for each pixel and supplying binary signals to respective ones of said pixel electrodes in synchronism with said successive scanning of said plural number of gate signal lines, with corresponding ones of said switching elements being turned on to select a corresponding one of said plurality of gate signal lines for one of plural approximately equal portions into which a corresponding one of said unit scanning periods is divided, said binary signals corresponding to different bit positions of said n bit data, respectively.

5. A liquid crystal display device according to claim 4, wherein said scanning drive circuit and said video signal drive circuit are fabricated on said one of said pair of opposing substrates.

6. A liquid crystal display device comprising:

a pair of opposing substrates;

a liquid crystal layer sandwiched between said pair of substrates;

a plurality of gate signal lines extending in one direction and arranged in another direction intersecting said one direction on a liquid-crystal-layer side surface of one of said pair of opposing substrates;

a plurality of drain signal lines arranged to intersect said plurality of gate signal lines;

a plurality of pixel areas each surrounded by two adjacent ones of said plurality of gate signal lines and two adjacent ones of said plurality of drain signal lines, each of said plurality of pixel areas being provided with a switching element operated by a scanning signal from one of said plurality of gate signal lines, and a pixel electrode supplied with a video signal from one of said plurality of drain signal lines via said switching element;

a scanning drive circuit for scanning successively a plural number of gate signal lines forming each of a plurality of groups, among said plurality of gate signal lines, in a first direction in parallel with said another direction with one unit scanning period, said unit scanning period being a subdivision of one field period, wherein said each of said plurality of groups is formed of said plural number of gate signal lines arranged in said each of said plurality of groups to be spaced from a preceding gate signal line thereof by lines successively smaller in number by a factor of approximately 2, said scanning of said plural number of gate signal lines is repeated in said first direction for each subsequent one of said plurality of groups of gate signal lines wherein said gate signal lines of said each subsequent one of said plurality of groups of gate signal lines are shifted in a second direction, opposite from said first direction, and a video signal drive circuit supplied with n bit display data representing a gray scale for each pixel from a field memory and supplying binary signals to respective ones of said plurality of pixel electrodes in synchronization with said successive scanning of said plural number of gate signal lines, with corresponding ones of said switching elements being turned on to select a corresponding one of said plurality of gate signal lines for one of plural approximately equal portions into which a corresponding one of said unit scanning periods is divided, said binary signals corresponding to different bit positions of said n bit data, respectively; and said field memory storing in a plurality of cells thereof n bit information representing gray scales to be written into said pixel areas, and outputting corresponding n bit information in synchronism with said successive scanning of said plurality of gate signal lines.

7. A liquid crystal display device according to claim 6, wherein said scanning drive circuit and said video signal drive circuit are fabricated on said one of said pair of opposing substrates.

* * * * *